US006675514B1

(12) United States Patent
Salimes et al.

(10) Patent No.: US 6,675,514 B1
(45) Date of Patent: Jan. 13, 2004

(54) MESSAGE CENTER ENCLOSURE AND METHOD FOR MAKING SAME

(75) Inventors: Christopher J. Salimes, Brookfield, WI (US); Robert D. Martin, Menomonee Falls, WI (US); Scott A. Andrzejewski, Glendale, WI (US)

(73) Assignee: Adaptive Micro Systems, Inc., Milwaukee, WI (US)

( * ) Notice: Subject to any disclaimer, the term of this patent is extended or adjusted under 35 U.S.C. 154(b) by 0 days.

(21) Appl. No.: 09/566,107

(22) Filed: May 5, 2000

(51) Int. Cl.[7] ..... G09F 3/04
(52) U.S. Cl. ..... 40/447; 40/575
(58) Field of Search ..... 40/447, 549, 739

(56) References Cited

U.S. PATENT DOCUMENTS

| | | | | | |
|---|---|---|---|---|---|
| 4,547,987 | A | * | 10/1985 | Stilling | 40/574 |
| 4,873,776 | A | * | 10/1989 | Hoffart | 40/572 |
| 5,042,182 | A | * | 8/1991 | King | 40/603 |
| 5,140,765 | A | * | 8/1992 | King | 40/603 |
| 5,270,910 | A | * | 12/1993 | Kile | 362/216 |
| 5,313,729 | A | | 5/1994 | Sakai et al. | 40/452 |
| 5,450,301 | A | | 9/1995 | Waltz et al. | 362/231 |
| 5,553,412 | A | * | 9/1996 | Briechle et al. | 40/124.01 |
| 5,872,926 | A | | 2/1999 | Levac et al. | 395/200.36 |
| 6,112,444 | A | * | 9/2000 | Milliken et al. | 40/603 |

OTHER PUBLICATIONS

ALPHA™ Get the message; 7 pages; © Copyright 1998 Adaptive Micro Systems, Inc., Form No. 9700–0044.

All American Scoretables, All American Scoreboards®; 2 pages A Product of Everbrite, Inc.

Know the score All American LED Indoor Scoreboards; 4 pages; All American Scoreboards®—A Product of Everbrite, Inc.

ALPHAVISION™ Industrial Information Displays; 2 pages; © Copyright 1998, Issued 1/98, Form No. 9702–0023.

Wireless Message Display Solutions For Business Communications; ALPHA ™; 4 pages; © Copyright 1996—Adaptive Micro Systems, Inc., © 1996 Motorola, Inc., Form No. 9708–8088.

ALPHA™ Digital Clock Synchronized Serial Version; 2 pages; © Copyright 1997—Adaptive Micro Systems, Inc., Revision Date 2/97, Form No. 9703–3003–A.

ALPHA™ IR Message Loader; 2 pages; Copyright 1998—Adaptive Micro Systems, Inc., Issue Date 3/98; Form No. 9706–5002.

ALPHA™ Director; 2 pages; © Copyright 1997—AMS, Inc, Issued 2/98, Form No. 9709–2011.

ALPHA™ PrintPak; 1 page; © Copyright 1995—Adaptive Micro Systems, Inc., Issue Date 5/95, Form No. 9708–8070.

ALPHA™ Big Dot™; 2 pages; © Copyright 1994, 1995—Adaptive Micro Systems, Inc., Issue Date 12/95, Form No. 9703–8003–A.

(List continued on next page.)

*Primary Examiner*—Lesley D. Morris
*Assistant Examiner*—Motilal P. Patel
(74) *Attorney, Agent, or Firm*—Foley & Lardner

(57) ABSTRACT

A display enclosure includes a case, a driver board assembly configured to provide signals to a display, a clamp assembly having a head configured to slidably engage the case and a protrusion configured to secure the driver board assembly to the case. A message center enclosure includes a case, a driver board assembly configured to generate a display, a pivot clamp assembly coupled to the case, and configured to couple the driver board assembly to the case, in a manner that is devoid of apertures through the driver board assembly for coupling the driver board assembly to the case. A method of manufacturing a message center enclosure includes obtaining a case having opposing first and second ends and at least one pivot clamp assembly, sliding a driver board assembly into the case, and sliding the pivot clamp assembly into the case.

26 Claims, 10 Drawing Sheets

OTHER PUBLICATIONS

ALPHA™ 7000 Series; 2 pages; © Copyright 1996—Adaptive Micro Systems, Inc., Issue Date 9/97, Form No. 9700–0031–T.

ALPHA™ 4000 Series; 2 pages; © Copyright 1996—Adaptive Micro Systems, Inc., Revision Date 9/97, Form No. 9701–8002–Rev A.

ALPHA™ 300 Series; 2 pages; © Copyright 1995—Adaptive Micro Systems, Inc., Issue Date 8/95, Form No. 9700–0030–T.

ALPHA™ 215 Series; 2 pages; © Copyright 1995—Adaptive Micro Systems, Inc., Revision Date 3/95, Form No. 9704–4001–A.

ALPHA™ 790i Outdoor Display; 4 pages; Copyright © 1990 Adaptive Micro Systems, Inc., Form #9704–9001.

ALPHA™ Personal Priority Display For Business Communications; 5 pages (including insert); © Copyright 1997 Adaptive Micro Systems, Inc., Printed 12/97, Form No. 9708–5004.

ALPHA™ SOLAR™ Quality LED Outdoor Business Communication; 5 pages (including insert); © Copyright 1997—Adaptive Micro Systems, Inc., Form No. 9705–1013.

ALPHAVISION™ Modular Display System; 8 pages; © Copyright 1995—AMS, Inc., Rev. 9/96, Form No. 9702–0001.

* cited by examiner

MESSAGE CENTER ENCLOSURE AND METHOD FOR MAKING SAME

FIELD OF THE INVENTION

This invention relates generally to the field of message center enclosures for indoor, outdoor, and transportation applications. More particularly, the invention relates to an improved message center enclosure that greatly reduces manufacturing and assembly costs without compromising the enclosure's function or aesthetics. The invention also relates to a method for making the improved message center.

BACKGROUND OF THE INVENTION

In the art of message center enclosures, including light emitting diode ("LED") message center enclosures, two manufacturing methods are primarily, currently in use. The first manufacturing method involves forming a sheet metal enclosure, which involves the steps of shearing a flat piece of sheet metal, punching the required holes into the sheet metal, forming additional metal parts, and welding the sheet metal and the parts together. This method requires expensive and time-consuming operations such as machine set-up, welding and metal finishing, and is typically only cost effective for large production volumes. The second manufacturing method involves an aluminum extrusion case and additional sheet metal parts. In this method the case is extruded in the desired shape; therefore, most of the machine set-up time and costs are eliminated. Although this method is better suited for a message center enclosure due to the lower production volumes and the large number of different required lengths for message centers, this method still requires costly secondary operations, such as drilling, tapping and punching holes, for the mounting of additional components such as a front panel, a power supply, circuit boards, etc. Secondary operations can increase the manufacturing cost of an extrusion design by 100 percent or more.

Message centers are used in a variety of indoor and outdoor applications that require message center enclosures to have design features that protect the message center from one or more of the following conditions: liquids, ice, vibration, dust, dirt, lint, fibers, or incidental contact. Message center enclosures typically require different enclosure features to meet different applications. Message center enclosures, capable of operating in a variety of applications, typically have higher costs due to the increased number of required design features and the cost of the secondary operations in the manufacture of such enclosures.

Accordingly, it would be advantageous to provide, a multi-purpose message center enclosure that is less expensive to manufacture. What is needed is a message center enclosure that eliminates most secondary operations such as the drilling, tapping and punching of holes. What is also needed is a message center enclosure design that is readily adaptable to most indoor and outdoor applications. It would be advantageous to provide a method of making a message center that is less expensive, quicker, cleaner, and safer.

SUMMARY OF THE INVENTION

According to one exemplary embodiment, display enclosure is disclosed which includes a case and a driver board assembly configured to provide signals to a display. The message center enclosure also includes a clamp assembly having a head configured to slidably engage the case and a protrusion configured to secure the driver board assembly to the case.

According to another exemplary embodiment, display enclosure is disclosed which includes a case having a first end positioned opposite a second end and a driver board assembly inserted into the case configured to provide signals to a display. The message center enclosure also includes a clamp assembly coupled to one of the case and the driver board assembly, the clamp assembly configured to secure the driver board assembly to the case.

According to yet another exemplary embodiment, message center enclosure is disclosed which includes a case, a driver board assembly configured to generate a display, and means for coupling a pivot clamp assembly to the case. The message center enclosure further includes means for coupling the driver board assembly to the case, the means for coupling the driver board assembly devoid of apertures through the driver board assembly for coupling the driver board assembly to the case.

According to yet another exemplary embodiment, method of manufacturing a message center enclosure includes obtaining a case having opposing first and second ends and at least one pivot clamp assembly and sliding a driver board assembly into the case. The method of manufacturing a message center enclosure further includes sliding the pivot clamp assembly into the case.

BRIEF DESCRIPTION OF THE DRAWINGS

The invention will become more fully understood from the following detailed description, taken in conjunction with the accompanying drawings, wherein like reference numerals refer to like parts, in which.

DETAILED DESCRIPTION OF THE PREFERRED EMBODIMENTS

Figure 1:
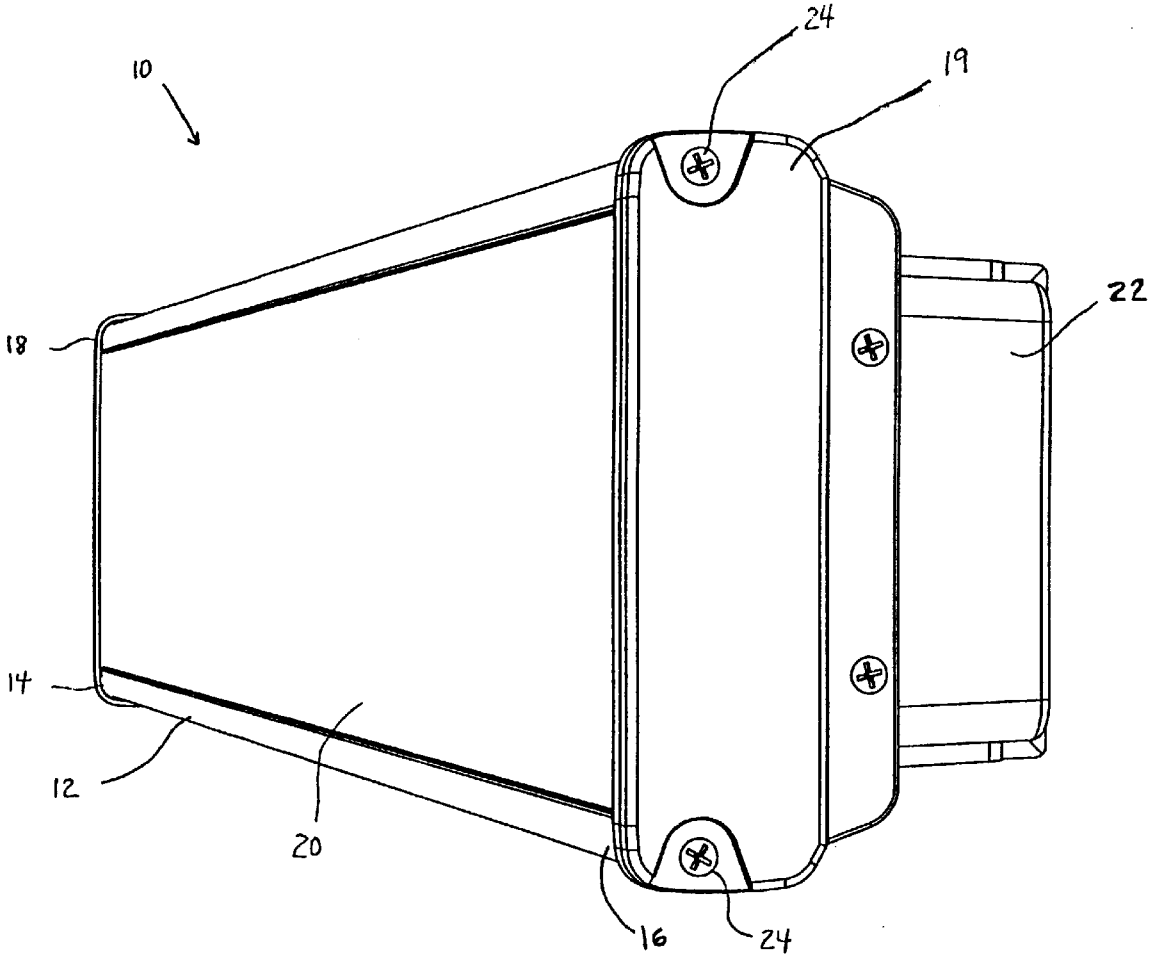
FIG. 1 is a front perspective view of a message center enclosure in accordance with an exemplary embodiment of the present invention.
Figure 2:
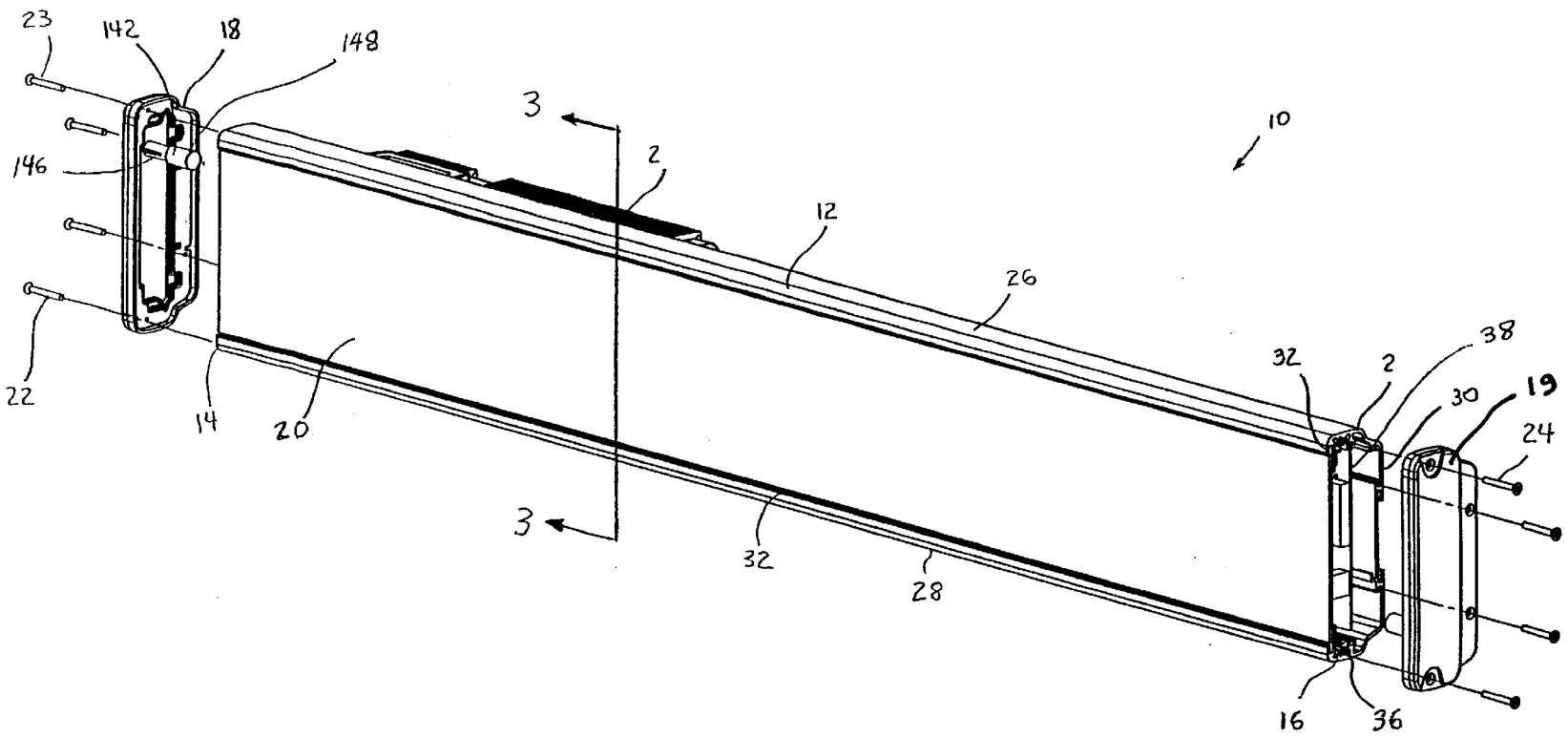
FIG. 2 is a front, exploded perspective view of the enclosure of FIG. 1.

Referring to FIGS. 1 and 2, a message center enclosure 10 according to an exemplary embodiment is shown. Enclosure 10 includes a case 12 having first and second ends 14, 16, first and second end caps 18, 19 a front panel 20 and a power supply assembly 22. Case 12 is, for example, an extrusion, preferably an aluminum extrusion. End caps 18, 19 are secured to ends 14, 16, respectively, of case 12 by fasteners, such as screws 23, 24. Other fastening arrangements such as clamps, resilient members, snap-tight assemblies, etc., are contemplated. Front panel 20 is made of a generally transparent material. According to an exemplary embodiment, enclosure 10 can satisfy at least four different applications: an indoor application; an indoor or outdoor application, NEMA 4, that provides protection against incidental contact, falling dirt, rain, sleet, snow, external formation of ice, windblown dust, splashing liquids, and hose-directed water; an indoor application, NEMA 12, that provides protection against incidental contact, falling dirt, circulating lint, fibers, and light splashing of liquids; and a transportation application, Society of Automotive Engineers (SAE)/TMC J1455 environmental practices for electronic equipment design.

Figure 3:
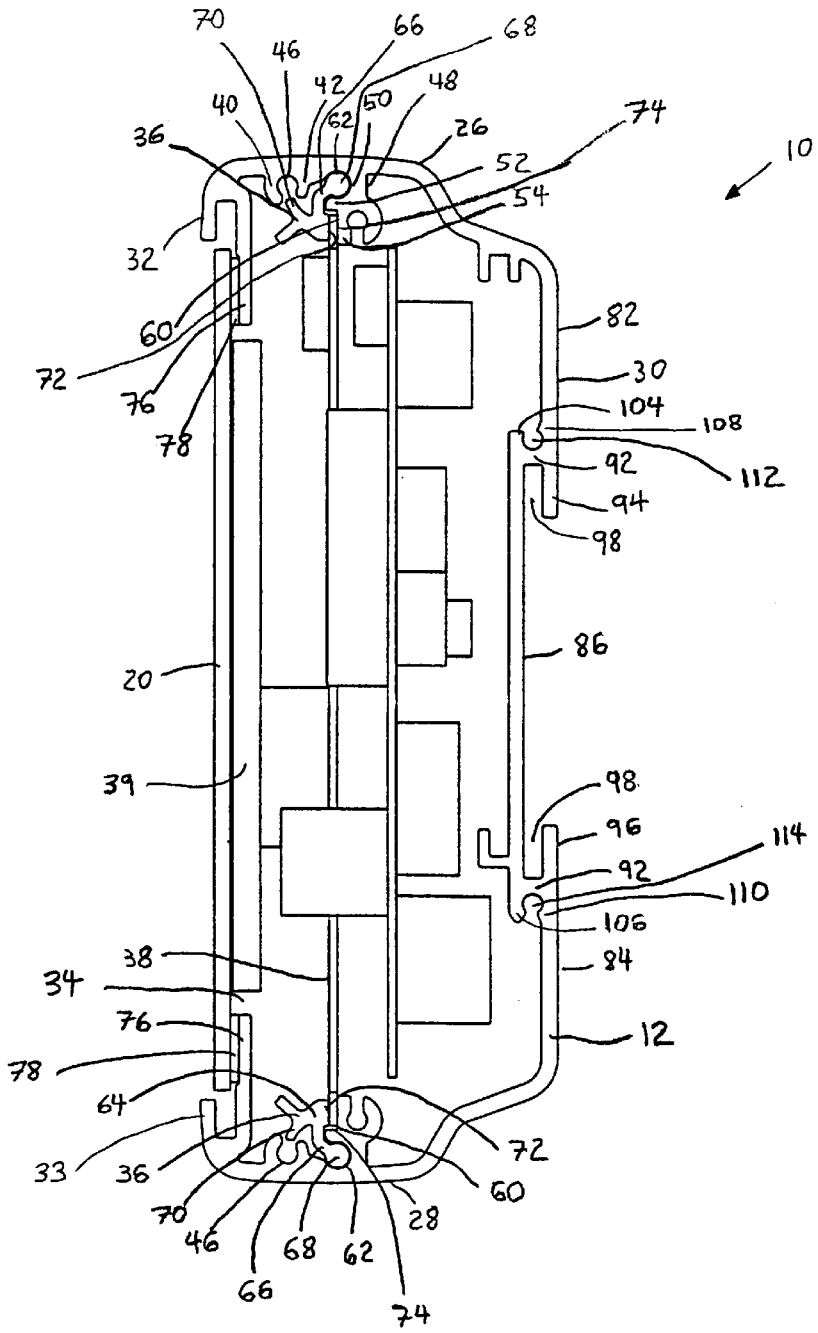
FIG. 3 is a partial cut-away view of the enclosure of FIG. 1 without the power supply assembly.

Referring to FIGS. 2 and 3, case 12 includes first and second side walls 26, 28 integrally formed to and extending forwardly, generally perpendicular from a rear wall 30. Each side wall 26, 28 includes a front extension 32, 33 that is integrally formed to each side wall 26, 28, respectively, and perpendicularly extends from one side wall toward, but without contacting, the other side wall to form a longitudinally extending front opening 34. Front panel 20 extends between front extensions 32 of first and second side walls 26, 28 to cover front opening 34. A pivot clamp assembly 36 is slidably connected to each side wall 26, 28. Each pivot clamp assembly pivots on an axis longitudinally extending between first and second ends 14, 16 of case 12. Referring to FIG. 3, a driver board assembly 38, for example, a driver board, is slidably engaged to first and second sides 26, 28 of case 12 and longitudinally extends through case 12 in a plane generally parallel to rear wall 30 and front panel 20 of case 12. Driver board assembly 38 includes display components 39 (e.g., seven-segment LEDs, light emitting diodes, lamps, bulbs, etc.) configured to present a message through front panel 20 based on control signals received from driver board assembly 38. In alternative arrangements, driver board assembly 38 may connect to only one side wall and occupy only a portion of the space between first side wall 26 and second side wall 28. In an exemplary embodiment, driver board assembly 38 is made of an aluminum alloy having a base thickness of approximately 0.06 inches.

Referring to FIG. 3, first and second sides walls 26, 28 each further include first and second curved members 40, 42 inwardly extending from each side wall 26, 28 positioned adjacent to front extension 32. First and second curved members 40, 42 curve toward each other forming a generally round boss slot 46. A protrusion 48 positioned adjacent to second curved member 42 extends inwardly from each side wall 26, 28. Protrusion 48 has a forwardly curved front face 50. Each side wall 26, 28 and front face 50 of protrusion 48 define a generally circular slot 62 within which pivot clamp assembly 36 rotates. Protrusion 48 further includes a stub 52 forwardly and generally perpendicularly extending from protrusion 48 and an end 54 extending from each side wall 26, 28. Stub 52 and end 54 of protrusion 48 form a ledge 60 which, in combination with pivot clamp assembly 36, holds driver board assembly 38. Driver board assembly 38 is slidably inserted between end 54 and pivot clamp assemblies 36, which eliminates the need for fasteners and secondary operations such as drilling or punching holes in case 12 and driver board assembly 38, and then tapping the holes for purposes of securely fastening driver board assembly 38 within case 12.

Figure 11:
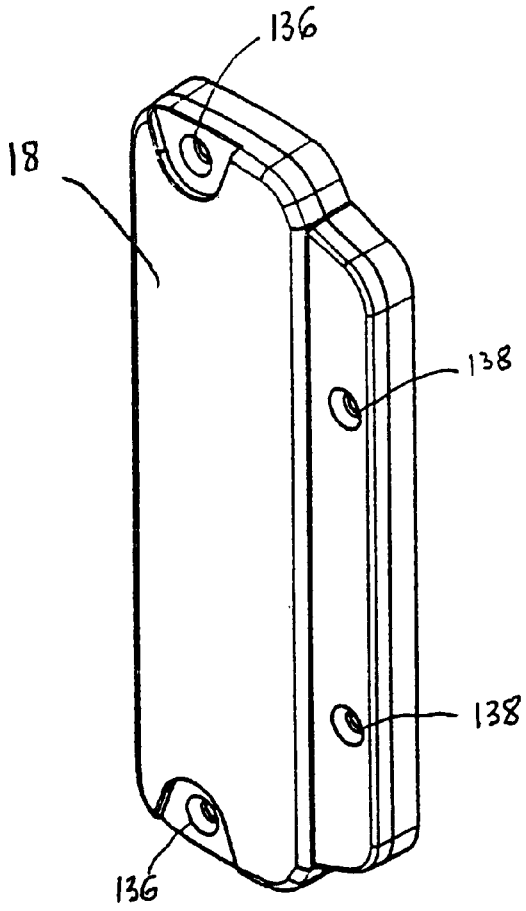
FIG. 11 is an outer perspective view of an end cap.
Figure 12:
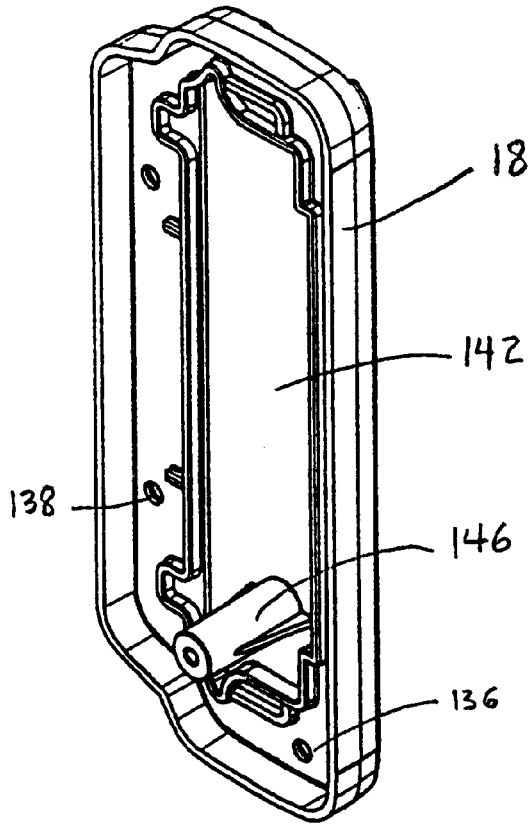
FIG. 12 is an inner perspective view of an end cap.

Referring to FIGS. 2, 3 and 11, end caps 18, 19 include a pivot clamp aperture 136. Screw 24 extends through pivot clamp aperture 136 of each end cap 18, 19 and into round boss slot 46 along the longitudinal axis of round boss slot 46. Each pivot clamp aperture 136 secures one end cap 18, 19 to case 12, forces the rotation of pivot clamp assembly 36 about an axis of rotation extending longitudinally through a circular slot 62 by contacting a second arm 70 of clamp assembly 36, and braces clamp assembly 36 against driver board assembly 38 thereby securing driver board assembly 38 to case 12. Clamp pivot assemblies 36 provide more clamping force than other fastening techniques and the force is uniformly applied over the entire length of driver board assembly 38.

Figure 4:
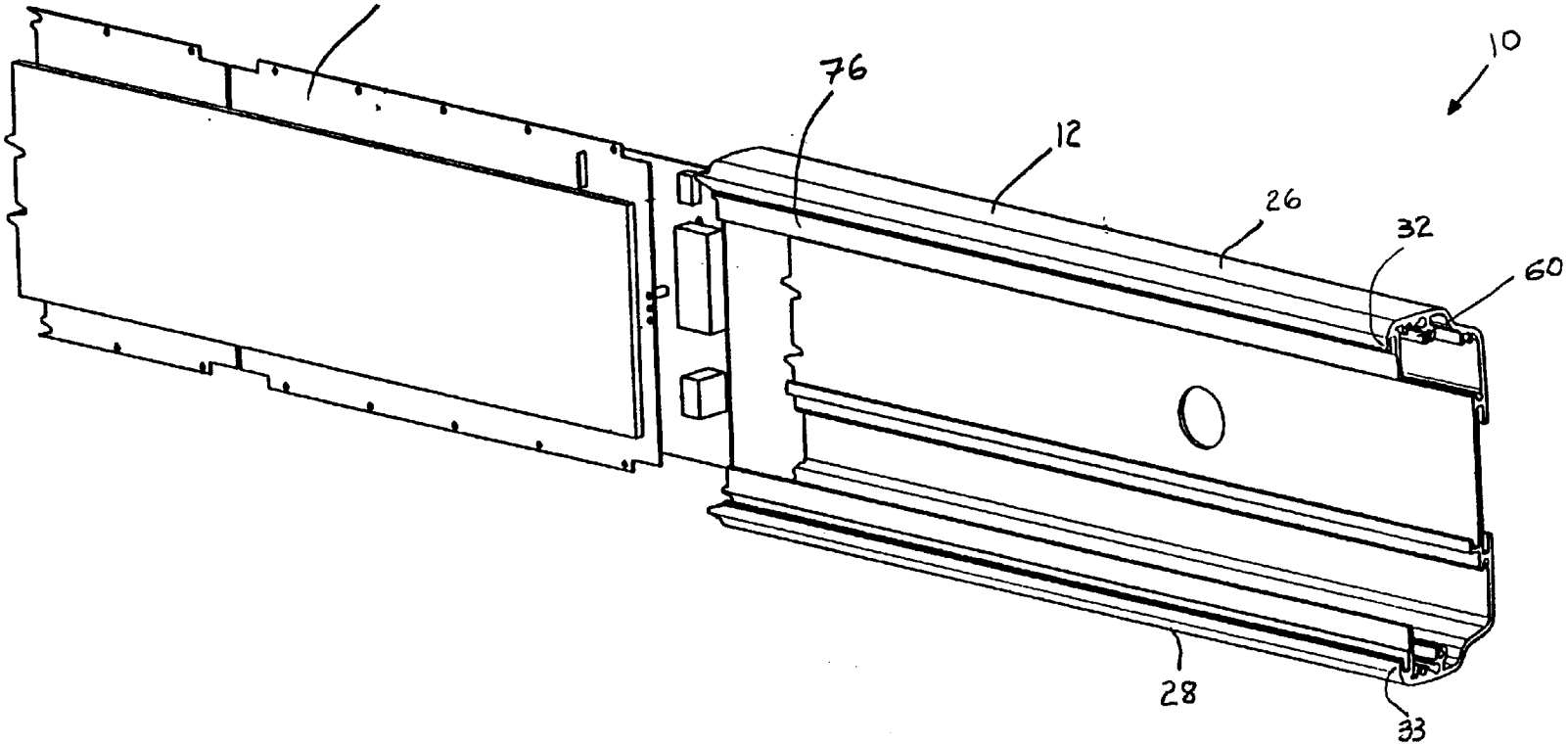
FIG. 4 is a front, perspective assembly view of a portion of the enclosure of FIG. 1 showing the case and the driver board assembly.
Figure 5:
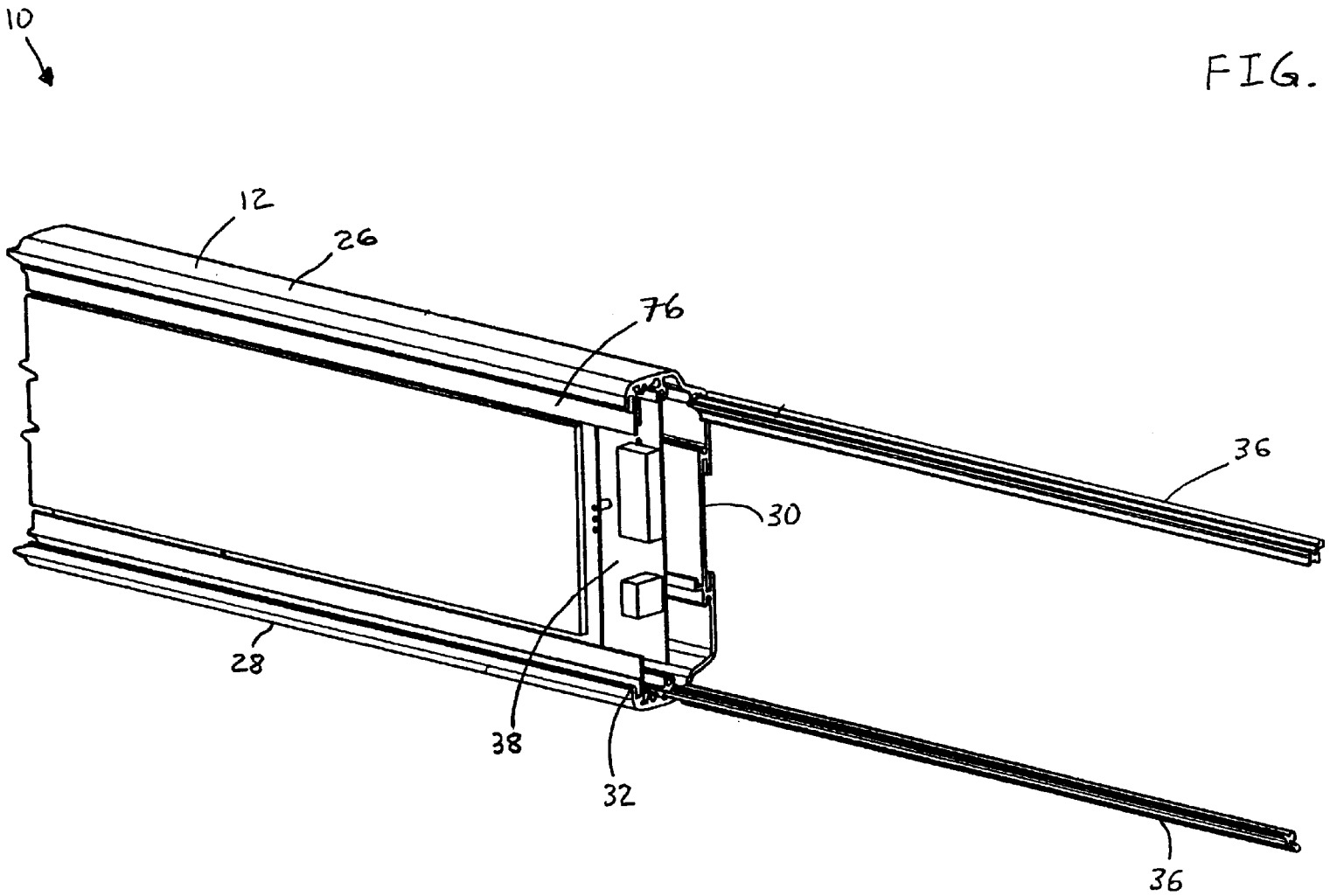
FIG. 5 is a front, perspective assembly view of the portion of the enclosure of FIG. 4 further showing the pivot clamp assemblies.

Referring to FIGS. 3, 4 and 5, driver board assembly 38 is slidably inserted into enclosure 10 at ledge 60 of first and second side walls 26, 28. Enclosure 10 includes two pivot clamp assemblies 36 longitudinally extending through case 12 and slidably couplable to first and second side walls 26, 28, respectively, through circular slot 62 of each side wall 26, 28. Referring to FIGS. 3 and 5, pivot clamp assembly 36 is an extrusion that includes a base 64 integrally formed to a first arm 66. First arm 66 extends from base 64 and integrally connects to a cylindrical head 68. Head 68 is sufficiently sized to fit within circular slot 62. First arm 66 is sized to allow for rotation of pivot clamp assembly 36 at head 68 about an axis of rotation longitudinally extending through circular slot 62. Second arm 70 positioned substantially perpendicular to first arm 66 is integrally connected to base 64 of pivot clamp assembly 36. Second arm 70 is sized to fit within round boss slot 46. Base 64 further includes a bracing surface 72 positioned substantially opposite second arm 70. Bracing surface 72 and ledge 60 form a control board channel 74 for securing driver board assembly 38 to case 12. According to an exemplary embodiment for NEMA and SAE/TMC applications, pivot clamp assemblies 36 are made of aluminum. While the exemplary pivot clamp assembly has been explained in detail, alternate clamp assemblies may be used. For example, clamp assembly 68 may extend only a portion of the distance between ends 14, 16.

Figure 6:
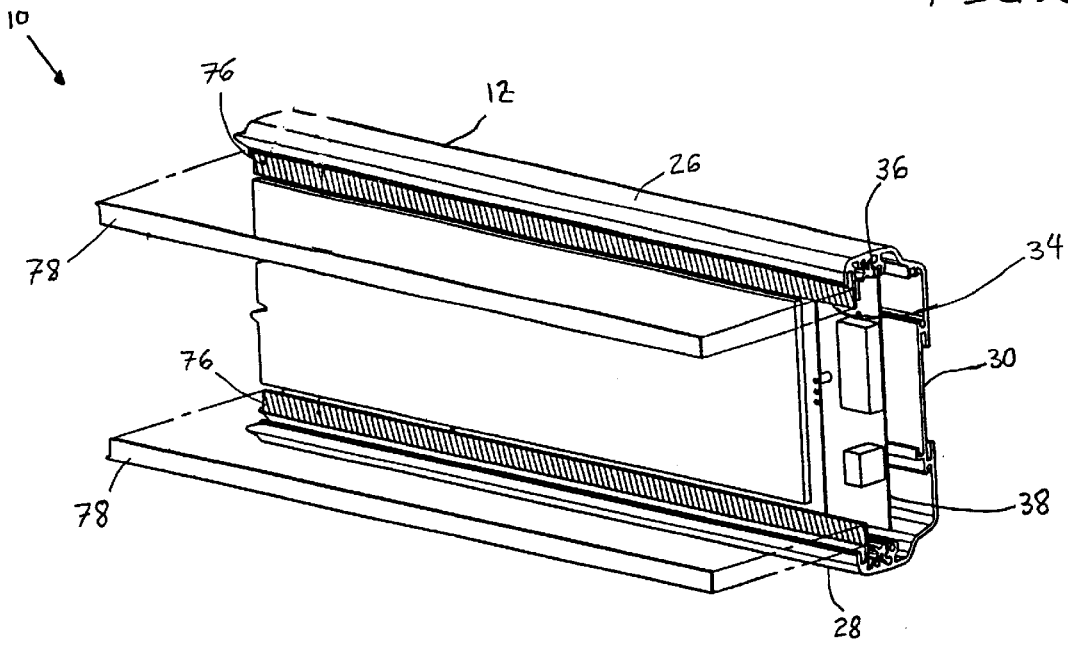
FIG. 6 is a front, perspective assembly view of the portion of the enclosure of FIG. 5 further showing the tape.
Figure 7:
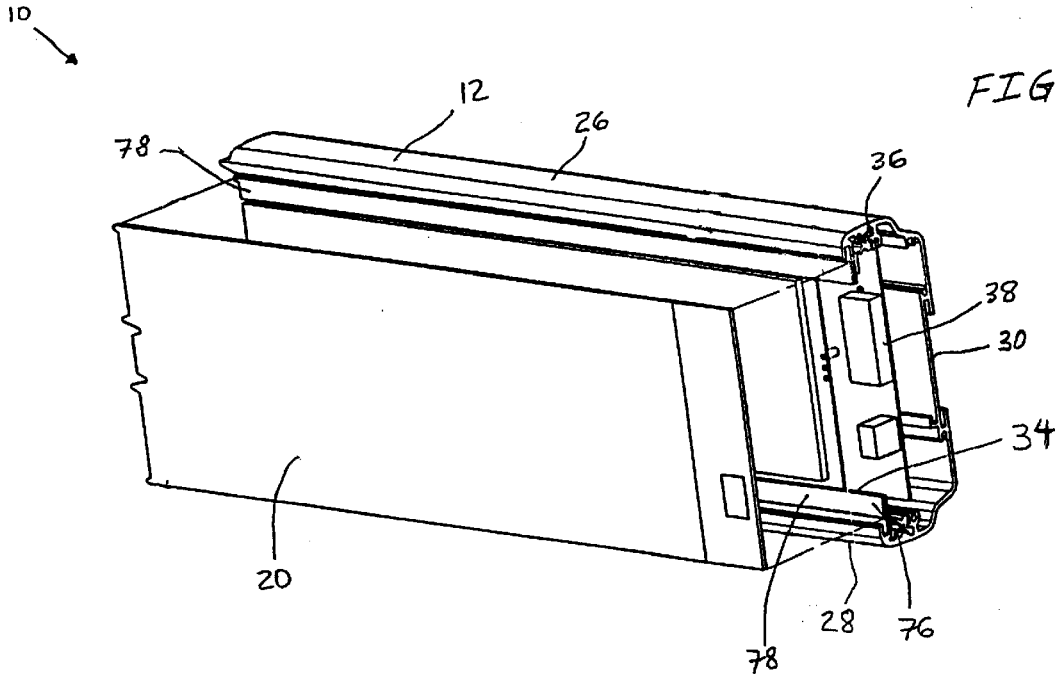
FIG. 7 is a front, perspective assembly view of the portion of the enclosure of FIG. 6 further showing the front opening.

Referring to FIGS. 4, 6 and 7, each front extension 32 of case 12 includes a recessed front mounting surface 76 at the edges of opening 34. A double-sided, very high bond ("VHB") tape 78 is bonded to front mounting surfaces 76. Front panel 20 is placed over and permanently bonded to tape 78 thereby covering opening 34 of case 12. Mounting of front panel 20 to front mounting surfaces 76 of case 12 with tape 78 eliminates the need for fasteners and secondary operations such as the drilling or punching, followed by the tapping, of holes into front extensions to accommodate fasteners for the purpose of mounting front panel 20 and the need to seal such holes to prevent water, dust or dirt from entering case 12. Tape 78 also provides a watertight seal between front panel 20 and case 12 that meets industry standards, particularly National Electrical Manufacturers Association (NEMA) standards. According to an exemplary embodiment, front panel 20 is permanently bonded to front mounting surfaces 76 of case 12 using double-sided VHB tape 78 having a thickness of approximately 0.06 inches as manufactured by 3M Corporation of St. Paul, Minn.

Figure 8:
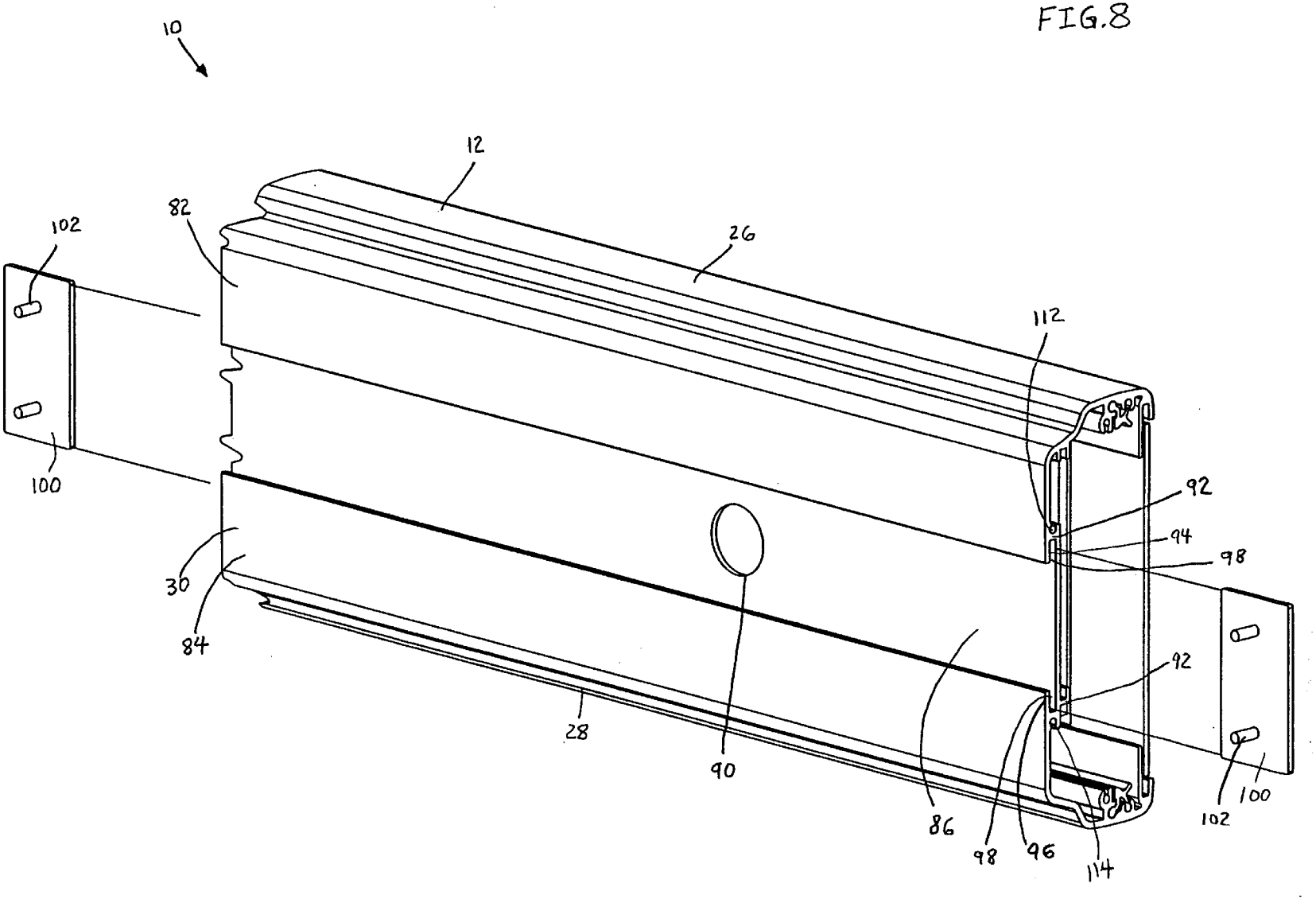
FIG. 8 is a rear, perspective assembly view of a portion of the enclosure of FIG. 1 showing the case and the power supply mounting brackets.

Referring to FIGS. 3 and 8, rear wall 30 of case 12 includes longitudinally extending first and second sections 82, 84 integrally formed to first and second side walls 26, 28, respectively. Rear wall 30 further includes a longitudinally extending and forwardly positioned center section 86 positioned in a plane that is parallel to first and second sections 82, 84 of rear wall 30. Center section 86 includes an aperture 90 for routing wires between power supply assembly 22 and driver board assembly 38 and is integrally formed to two landings 92. Landings 92 are aligned spaced apart and generally perpendicular to center section 86 and first and second sections 82, 84. Landings 92 couple center section 86 to first and second sections 82, 84 so as to leave overhanging portions 94, 96 of first and second sections 82, 84 disposed over center section 86. Each overhanging portion 94, 96, landing 92, and center section 86 defines a power supply mounting groove 98. Two rectangular shaped power supply mounting brackets 100 are slidably connected to case 12 through power supply mounting grooves 98. Each bracket 100 includes two rearwardly and perpendicularly extending fasteners (shown as studs 102 in FIG. 8). Each bracket 100 is sized to cover only a portion of center section 86 in a longitudinal direction, thereby allowing brackets 100 to be placed in a variety of locations along power supply mounting grooves 98 to accommodate a variety of power supply configurations without blocking aperture 90 in center section 86. Referring to FIG. 3, center section 86 includes first and second rearwardly curved edges 104, 106 disposed over first and second sections 82, 84 of rear wall 30, respectively. First and second sections 84, 86 each include a forwardly extending and longitudinally positioned ridge 108, 110 positioned opposite the first and second center section edges 104, 106, respectively. First center section edge 104, landing 92 and first ridge 108 define a first fastener slot 112. Second center section edge 106, landing 92 and second ridge 110 define a second fastener slot 114.

Figure 9:
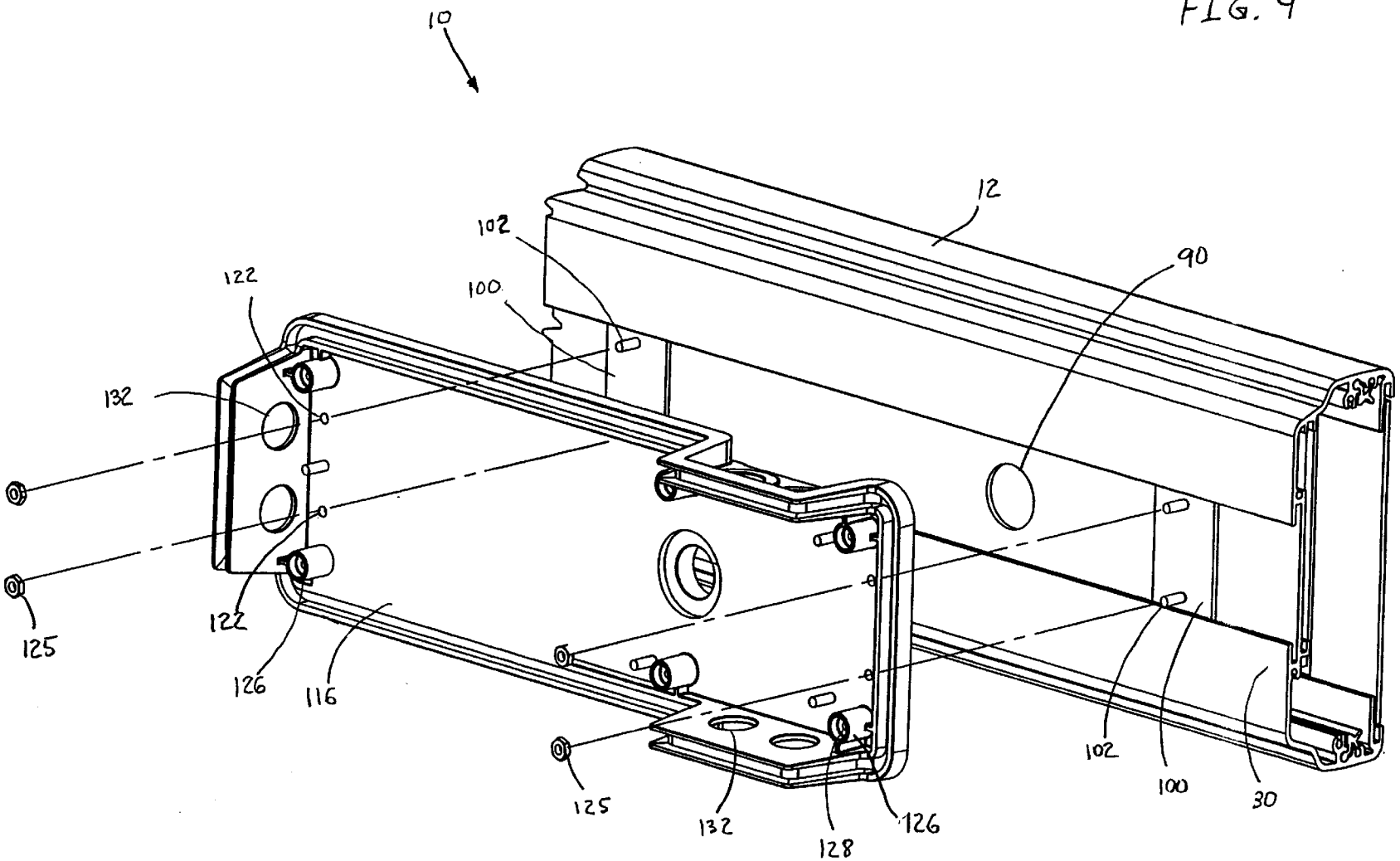
FIG. 9 is a rear, perspective assembly view of the portion of the enclosure of FIG. 8 further showing the power supply base.
Figure 10:
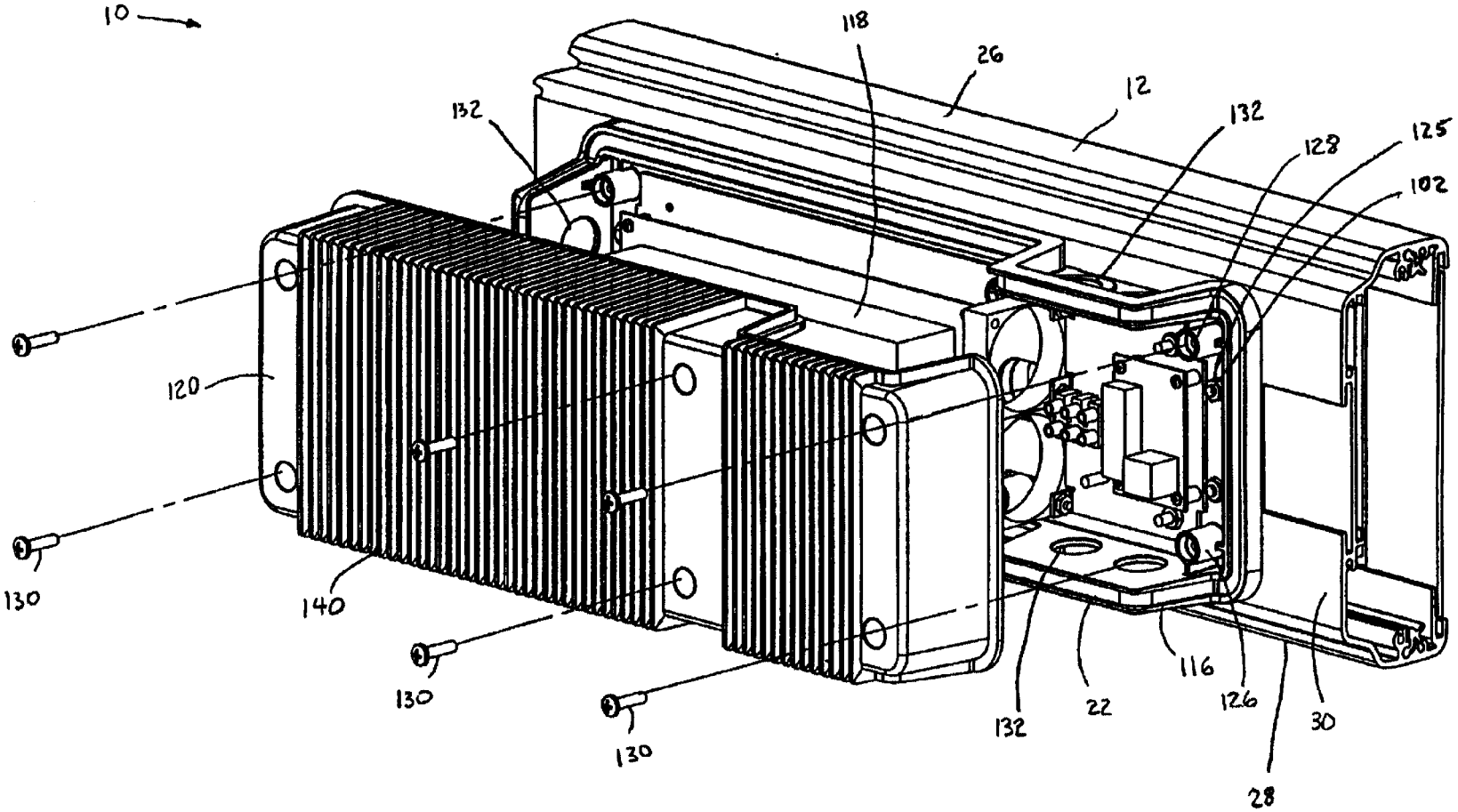
FIG. 10 is a rear, perspective assembly view of the portion of the enclosure of FIG. 9 further showing the power supply and the power supply housing.

Referring to FIGS. 9 and 10, power supply assembly 22 (as shown in FIG. 10) includes a power supply base 116 coupled to case 12, a power supply 118 coupled to power supply base 116 by fasteners (not shown), and a power supply housing 120 coupled to power supply base 116. Power supply base 116 includes four holes 122 to accommodate studs 102 from brackets 100. Power supply base 116 fits over studs 102 and is secured to case 12 by four nuts 125. Power supply base 116 includes a plurality of bosses 126 each containing a bore 128 to which housing 120 is mounted to power supply base 116 by fasteners (shown as pan screws 130 in FIG. 10). Other fasteners for coupling power supply base 116 to case 12 and power supply housing 120 to power supply base 116 are contemplated such as clamps, glue and snap-tight assemblies. Power supply base 116 further includes three sets of conduit holes 132 with removable plug hole seals (not shown), two of the three sets are positioned adjacent to first and second side walls 26, 28, and the third set is positioned toward first end 14 of case 12. A power supply low porosity grade foam gasket (not shown) is attached to housing 120 to make power supply assembly 22 water, dust, and dirt resistant. According to an exemplary embodiment, the power supply low porosity foam gasket is a Poron gasket supplied by Rogers Corporation of Woodstock, Conn. which includes an acrylic adhesive coating of approximately 0.005 inches in thickness on one side. The mounting of power supply base 116 to case 12 eliminates secondary operations such as drilling or punching, and then tapping, holes in case 12 to accommodate fasteners for the purpose of mounting power supply assembly 22 to case 12 and the need to seal such holes to prevent water, dust or dirt from entering case 12. This type of mounting also eliminates the need for sealing washers to seal holes that result in conventional mounting methods. According to an exemplary embodiment, power supply base 116 is an aluminum alloy casting having a nominal thickness of approximately 0.156 inches and is symmetrical about a centerline extending longitudinally through enclosure 10. According to an exemplary embodiment, housing 120 includes a nominal wall thickness of approximately 0.125 inches and a plurality of external, outwardly extending fins 140 disposed in a spaced apart, parallel configuration. The external fins 140 increase the surface area of housing 120 and assist in dissipating heat generated from power supply 118.

Referring to FIGS. 2, 3, 11 and 12, end cap 18, 19 (as shown in FIGS. 1 and 2) includes two pivot clamp assembly apertures 136 and two rear wall apertures 138. Two pivot clamp assembly apertures 136 are positioned over round boss slot 46 of first and second side walls 26, 28. Two rear wall apertures 138 are positioned over first and second fastener slots 112, 114 at each end of rear wall 30. Each end cap 18, 19 includes an inner surface 142 and is symmetrical about a centerline 144 extending longitudinally through case 12 with the exception of a vibration mount support 146 integrally connected to and inwardly extending from inner surface 142 of end cap 18, 19. A vibration mount 148 is threadedly connected to vibration mount support 146. In an exemplary embodiment, vibration mount 148 of end cap 18, 19 is made of rubber. An end cap low porosity grade foam gasket attaches to the inner surface 142 of end cap 18, 19. According to an exemplary embodiment, end cap low porosity foam gasket is a Poron gasket, part #4701-40-15188-04 supplied by Poron by Rogers Corporation of Woodstock, Conn. having an uncompressed thickness of approximately 0.1875 inches and includes an acrylic adhesive coating of approximately 0.005 inches in thickness on one side. End cap 18, 19 is also supplied with a stop when the Poron gasket material is compressed by approximately 50 percent. End cap 18, 19 is coupled to case 12 by screws 23, 24 inserted through pivot clamp assembly apertures 136 and rear wall apertures 138 into round boss slots 46 and first and second fastener slots 112, 114 of case 12. End cap 18, 19 is configured for mounting on either first end 14 or second end 16 of case 12. End cap 18, 19 mounted to first end 14 has vibration mount 148 located in close proximity to first side wall 26 and end cap 18, 19 mounted to second end 16 has vibration mount 148 located in close proximity to second side wall 18. This end cap configuration allows end cap 18, 19 to fit on either end of case 12. Round boss slots 46 and first and second fastener slots 112, 114 of case 12 eliminate the need to drill or punch, and then tap, holes in case 12 to accommodate screws 23, 24 for connecting end cap 18, 19, respectively, to case 12.

According to an exemplary embodiment for NEMA and SAE/TMC applications, housing 120 and end caps 18, 19 are watertight aluminum castings that add to the structural integrity of enclosure 10 and are capable of withstanding a 30 G shock test and vibration testing. According to an exemplary embodiment for NEMA and SAE/TMC applications, end caps 18 further include recessed molded seals. According to an exemplary embodiment for indoor (non-NEMA) applications, end caps are made of injection molded plastic. The injection molded plastic end cap is less expensive to manufacture and can be molded in a number of colors to match a decor and to eliminate painting of end cap 18.

According to an exemplary embodiment, the outer surfaces of case 18, power supply housing 120, and end caps 18, 19 can be painted in a number of different colors to coordinate the enclosure to a decor. According to an exemplary embodiment, wall mounting brackets are attached to enclosure 10.

A method of manufacturing the exemplary embodiment of FIG. 1 through 12 includes extruding or obtaining case 12 and pivot clamp assembly 36 extrusions. The method further includes cutting case 12 and clamp assembly 36 extrusions to the desired length. Preferably, the case 12 and clamp assembly 36 extrusions are cut to approximately equal lengths. The method further includes obtaining driver board assembly 38 and sliding driver board assembly 38 into ledges 60 of case 12. The method further includes sliding two pivot clamp assemblies 36 into circular slots 62 of case 12. The method further includes allowing second arm 70 of clamp assembly 36 to enter round boss slot 46 between first and second curved members 40, 42. The method further includes sliding two brackets 100 into power supply mounting grooves 98 of case 12, placing power supply base 116 over studs 124 of brackets 100 and fastening power supply base 116 to case 12 with nuts 125. The tightening of nuts 125 over studs 102 of bracket 100 compresses brackets 100 against power supply mounting grooves 98 of case 12. The method further includes coupling power supply 118 to power supply base 116 with fasteners, attaching power supply gasket to supply base 116, and coupling housing 120 to bosses 126 of power supply base 116 with pan screws 130. The method further includes applying tape 78 to front mounting surfaces 76 of case 12 and placing and bonding front panel 20 on tape 78 to secure front panel 20 to case 122 The method further includes cleaning the inside surface of end cap 18 with isopropyl alcohol and water and letting dry, attaching end cap gasket to the inner surface 142 of end cap 18, and fastening vibration mounts 148 to end caps 18. The method further includes securing end caps 18 to first and second ends 14, 16 of case 12 to seal the ends of case 12 and front panel 20 by inserting screw 24 through pivot clamp aperture 36 of end cap 18 and into round boss slot 46 along the longitudinal axis of round boss slot 46. Pivot clamp aperture 136 secures end cap 18 to case 12, forces the rotation of pivot clamp assembly 36 about an axis of rotation extending longitudinally through circular slot 62 by contacting second arm 70 of clamp assembly 36, and braces clamp assembly 36 against driver board assembly 38 thereby securing driver board assembly 38 to case 12.

While the embodiments illustrated in the FIGURES and described above are presently preferred, it should be understood that these embodiments are offered by way of example only, and various alternatives would be apparent to those of skill in the art. For example, the case could include a first side wall as described above and a second side wall having a fixed driver board assembly groove which would allow the enclosure to include only one pivot clamp assembly to secure the driver board assembly to the case. Under this alternative embodiment, the driver board assembly would be slidably inserted into the fixed driver board assembly groove and the ledge of the case, and then a single pivot clamp assembly would be slidably inserted into the first wall for the purpose of holding the driver board assembly in place when secured by the end caps and associated fasteners. In another alternative embodiment, each end cap includes a single pivot clamp assembly aperture and a wedge inwardly extending from the inner surface of the end cap. The wedge inserts into the round boss slot of one side of the case and secures the pivot clamp assembly against the driver board assembly without securing the end cap to the case. A screw placed through the single pivot clamp assembly aperture inserts into the round boss slot at the other side of the case to secure the end cap to the case and to position the pivot clamp assembly against the driver board assembly. In another alternative embodiment, the clamp assembly includes a round head and a leg, and each side of the case includes two slots positioned side by side, the round head is inserted into the first slot creating a hinge and the leg inserts into a second slot to provides a means for rotating and securing clamp assembly against the driver board assembly when a fastener is inserted longitudinally into the second slot. In another alternative embodiment, the front panel is secured to the front mounting surfaces of the case by a glue. In an alternative embodiment, the front extensions of case include front panel grooves for slidably mounting a front panel over the front opening of the case. In an alternative embodiment, the first and second side walls of the case further include a second round boss slot for inserting a second circuit board assembly into the case. In an alternative embodiment, the end caps are secured to the case by an alternative fastening means such as clamps, glue, etc. In an alternative embodiment a cross support mounting bracket is secured to the case by sliding into a T groove in the case to increase the tightening of the bracket to the case. The invention is not limited to a particular embodiment, but extends to various modifications that nevertheless fall within the scope of the appended claims.

What is claimed is:

1. A display enclosure, comprising:

a case;

a driver board assembly configured to provide signals to a display;

a clamp assembly having a head configured to slidably engage the case and an extrusion configured to secure the driver board assembly to the case; and an end cap coupled to an end of the case and configured to provide a force against the extrusion to secure the driver board assembly to the case.

2. The display enclosure of claim 1, wherein the case has a length, the clamp assembly extending substantially the length of the case.

3. The display enclosure of claim 1, wherein the clamp assembly is configured to pivot on the head.

4. The display enclosure of claim 1, further comprising a display coupled to the driver board assembly.

5. The display enclosure of claim 1, further comprising a second clamp assembly disposed in the case a distance from the first clamp assembly, the second clamp assembly having a head configured to slidably engage the case and a protrusion configured to secure the driver board assembly to the case.

6. A display enclosure, comprising:

a case having a first end positioned opposite a second end;

a driver board assembly inserted into the case and configured to provide signals to a display;

a first clamp assembly having a head coupled to one of the case and the driver board assembly, the first clamp assembly having a protrusion configured to contact the driver board assembly: and at least one end cap coupled to the case and configured to engage the first clamp assembly to secure the driver board assembly to the case.

7. The display enclosure of claim 6, wherein the at least one end cap further comprises a first end cap coupled to the first end of the case and a second end cap coupled to the second end of the case, the first end cap and the second end cap configured to provide a force against the protrusion to secure the driver board assembly to the case.

8. The display enclosure of claim 6, wherein the case has a length, the clamp assembly extending substantially the length of the case.

9. The display enclosure of claim 6, wherein the clamp assembly is configured to pivot on the head.

10. The display enclosure of claim 7, wherein the first and second end cap has at least one aperture, and further comprising at least one fastener for coupling the first and second end cap to the case.

11. The display enclosure of claim 6 further comprising a second clamp assembly coupled to the case for securing the driver board assembly to the case.

12. The display enclosure of claim 6, wherein the driver board assembly is devoid of apertures for mounting the driver board assembly to the case.

13. The display enclosure of claim 6 wherein the driver board assembly and the first clamp assembly are slidably coupled to the case.

14. The display enclosure of claim 6 further comprising a front panel coupled to the case.

15. The display enclosure of claim 14 further comprising a tape connecting the front panel to the case.

16. The display enclosure of claim 6 further comprising a power supply coupled to the case.

17. The display enclosure of claim 6 wherein the case further comprises first and second side walls coupled to and extending forwardly, substantially perpendicular from a rear wall, wherein each side wall has first and second longitudinally extending slots.

18. The display enclosure of claim 9, wherein the clamp assembly comprises:

a base, the base having a bracing surface; and first and second arms extending from the base.

19. The display enclosure of claim 18, wherein the first arm includes a head, the head pivotally coupled to a first slot of either side wall, and the second arm is sufficiently sized to fit within a second slot of the same side wall.

20. The display enclosure of claim 17, wherein the rear wall has a plurality of longitudinally extending overhanging portions.

21. The display enclosure of claim 20, wherein the overhanging portions of the rear wall form a channel and further comprising:

at least one power supply mounting bracket slidably inserted into the channel, and;

a power supply assembly coupled to the power supply mounting bracket.

22. The display enclosure of claim 7 wherein the case, the first and second end caps, and the clamp assembly or a combination thereof are made of aluminum.

23. A message center enclosure comprising:

a case;

a driver board assembly configured to generate a display;

means for coupling a pivot clamp assembly to the case; and means for clamping the driver board assembly to the case along substantially an entire length of the driver board assembly.

24. The message center enclosure of claim 23 further comprising a front panel coupled to the case.

25. The message center enclosure of claim 23 further comprising a power supply coupled to the case.

26. The message center enclosure of claim 23, further comprising an end cap coupled to an end of the case and configured to provide a force against the pivot clamp assembly to secure the driver board assembly to the case.

* * * * *